US008389836B2

(12) United States Patent
Uberbacher

(10) Patent No.: US 8,389,836 B2
(45) Date of Patent: Mar. 5, 2013

(54) BRIDGE ELEMENT FOR MUSICAL STRINGED INSTRUMENTS

(75) Inventor: René Uberbacher, Johannesburg (ZA)

(73) Assignee: René Uberbacher, Johannesburg (ZA)

( * ) Notice: Subject to any disclaimer, the term of this patent is extended or adjusted under 35 U.S.C. 154(b) by 257 days.

(21) Appl. No.: 12/525,379

(22) PCT Filed: Jan. 30, 2008

(86) PCT No.: PCT/IB2008/000197

§ 371 (c)(1),
(2), (4) Date: Jul. 31, 2009

(87) PCT Pub. No.: WO2008/093212

PCT Pub. Date: Aug. 7, 2008

(65) Prior Publication Data

US 2010/0000392 A1 Jan. 7, 2010

(30) Foreign Application Priority Data

Jan. 31, 2007 (GB) ..... 0701846.8

(51) Int. Cl.
*G10D 3/04* (2006.01)

(52) U.S. Cl. ..... 84/312 R; 84/298; 84/307

(58) Field of Classification Search ..... 84/312 R
See application file for complete search history.

(56) References Cited

U.S. PATENT DOCUMENTS

| | | | | |
|---|---|---|---|---|
| 2,714,326 | A * | 8/1955 | McCarty | 84/299 |
| 3,181,409 | A * | 5/1965 | Burns et al. | 84/313 |
| 3,411,394 | A * | 11/1968 | Jones | 84/313 |
| 3,422,509 | A * | 1/1969 | Porter | 84/313 |
| 3,500,711 | A * | 3/1970 | Fender | 84/313 |
| 4,100,832 | A * | 7/1978 | Peterson | 84/313 |
| 4,512,232 | A * | 4/1985 | Schaller | 84/313 |
| 4,648,304 | A * | 3/1987 | Hoshino et al. | 84/313 |
| 4,656,915 | A * | 4/1987 | Osuga | 84/313 |

(Continued)

FOREIGN PATENT DOCUMENTS

| | | |
|---|---|---|
| EP | 0626673 | 6/1994 |
| WO | WO 94/05003 | 3/1994 |
| WO | WO 2006/023600 | 3/2006 |

*Primary Examiner* — Christopher Uhlir

(74) *Attorney, Agent, or Firm* — Fay Sharpe LLP

(57) ABSTRACT

A stringed instrument, for example an electric guitar, is arranged to produce a tremolo effect by providing the tailpiece with a number of saddles corresponding to the number of strings, each saddle having a slot for anchoring its string. The tailpiece is pivotable about an axis substantially perpendicular to the strings in order to change the tension in the strings to produce the desired tremolo effect. The tailpiece includes a housing in which the saddles are provided with a screw adjustment which varies the off-set of the saddle from the axis of the pivot. The greater the off-set of the saddle from the pivot, the greater the extension or release of the string on activation of the tremolo lever to turn the tailpiece. Thus, the position of the saddles relative to each other can be made so that on activation of the lever which pivots the tailpiece, the strings whose tension is changed remain in harmony. If desired, some of the strings can be 'de-activated' by adjusting the saddle position so that the string remains on the axis of the pivot so that no change in string tension results as the tailpiece is pivoted.

15 Claims, 7 Drawing Sheets

U.S. PATENT DOCUMENTS

| | | | | |
|---|---|---|---|---|
| 4,690,027 | A | 9/1987 | Ido | |
| 4,768,415 | A | 9/1988 | Gressett, Jr. et al. | |
| 5,419,227 | A * | 5/1995 | Lavineway | 84/313 |
| 2003/0066407 | A1 | 4/2003 | Shimooka et al. | |
| 2005/0150348 | A1 * | 7/2005 | Ito | 84/299 |
| 2005/0155480 | A1 * | 7/2005 | Joseph | 84/299 |
| 2006/0213350 | A1 * | 9/2006 | Davis | 84/313 |
| 2006/0272471 | A1 | 12/2006 | Lavineway | |

* cited by examiner

BRIDGE ELEMENT FOR MUSICAL STRINGED INSTRUMENTS

This invention relates to musical string instruments, and in particular to a device and an arrangement permitting such instruments to be played to produce a tremolo effect.

Some instruments, particularly electric guitars, have been fitted with or may be adapted with a bridge system designed to produce such a tremolo effect. Those that are factory-fitted are often heavy, and require significant removal of wood from the body of the guitar. Those that are post-fitted also require removal of wood from the guitar. Both systems operate by allowing the musician playing the instrument selectively to press on a lever which moves the tailpiece which holds the ends of the strings to reduce the tension of the strings thus producing the desired tremolo effect. Although this system has been in use since about 1954, there are a number of disadvantages which the present invention seeks to avoid; the advantages of the invention are set out below.

Explanation of terms used in this specification:

Tuning Keys/Fine Tuning: these are provided to achieve the desired tension in the strings; they allow the strings to be tuned in harmony with each other. They are provided at the end of the neck of the instrument, but sometimes (additional) keys are provided on the tailpiece of the instrument.

Intonation Adjustment: this is provided to achieve the correct length of string. It can be considered as a compensation for how hard or softly a player presses the strings down on the frets, the geometry of the instrument, differing string gauges, and for different tunings of the instrument.

Harmony Adjustments: these are provided to keep the strings in harmony with each other when the tremolo effect is applied.

In accordance with the invention a stringed instrument, for example an electric guitar, is arranged to produce a tremolo effect by providing the tailpiece with a number of saddles corresponding to the number of strings, each saddle having a slot for anchoring its string, and arranging that the tailpiece is pivotable about an axis substantially perpendicular to the strings in order to change the tension in the strings to produce the desired tremolo effect.

The tailpiece conveniently comprises a housing in which the saddles are provided with a screw adjustment which varies the off-set of the saddle from the axis of the pivot. The greater the off-set of the saddle from the pivot, the greater the extension or release of the string on activation of the tremolo lever to turn the tailpiece. Thus, the position of the saddles relative to each other can be made so that on activation of the lever which pivots the tailpiece the strings whose tension is changed remain in harmony. If desired, some of the strings can be 'de-activated' by adjusting the saddle position so that the string remains on the axis of the pivot so that no change in string tension results as the tailpieces is pivoted.

In the 'normal' (tuned) position of the tailpiece, it is held against a fixed stop by the tension in the strings if the tremolo effect is to be achieved by increasing the tension in the majority of the strings. Otherwise, it will be necessary for the tailpiece to be held in its 'normal' position by means of a spring or springs.

In a preferred embodiment, unlike present bridge systems which are arranged to reduce the tension of the string or strings to produce a tremolo effect, the present invention over-tensions the strings. This has two specific benefits: first, no additional springs or the like are required to bring the strings back to their normal (tuned) tension. Secondly, when the string tension is reduced, there is a greater tendency for the tuning keys at the outer end of the neck to slip allowing the normal (tuned) tension to reduce, and for the instrument thus to go out of tune more quickly.

The form of the saddles is very important. The preferred form is in the form of a banana having an upstand with a slot for holding the ball at the end of the string. In use, the string is wound round the outer surface of the saddle covering an angle of 270 to 360°. In this way over-tensioning of the string does not put additional pressure on the ball at the end of the string, and the rounded form of the saddles results in no concentration of forces at the end of a string at a sharp edge or where it is wound round a key.

Furthermore, the saddles are designed to be reversible within the housing in the tailpiece, so that if desired some or all of the strings can be dropped in tension to produce the desired tremolo effect. If the majority of the strings are arranged to drop in tension when the tremolo lever is activated, it will be necessary to provide a spring between the tailpiece and the body of the guitar in order to counteract the effect of the tension in the strings and to bring the tailpiece back to its normal position.

Typically, the tremolo lever will cause the tailpiece to be rotated through an angle of up to 15° which will cause the strings to be stretched (or relaxed) by 2 to 3 mm. The amount of variation of tension on the string will depend on the offset of the saddle (and thus the offset of the respective string) from the axis of the pivot. The offset of each string is adjusted as required for the strings to remain in harmony when the tremolo lever is depressed. If one or more strings is to be de-activated, the offset is reduced to 0 mm.

In order to intone the instrument and to achieve the best results in respect of the tremolo effect, the instrument is additionally provided with an intonation bridge with separate rollers for each string. Each roller has a longitudinal screw adjustment and is thus capable of discrete longitudinal adjustment for its respective string with respect to the frets. Intoning or intonation adjustment allows the micro-adjustment of the length of each string so that they can be adjusted to vibrate in harmony regardless as to which fret is used on the neck of the guitar. In other words, as described above, the intonation adjustment can compensate for differences in the geometry of the instrument, differences in the string or the way the instrument is played.

The rollers act as an anti-friction device thus reducing the tendency of the strings to break at the level of the intonation piece or bridge.

The tailpiece and/or intonation bridge are conveniently provided with holes at either end permitting it or them to be bolted to an instrument using existing (standard) screw-threaded holes on the instrument so that the whole device can be fitted to an instrument without expert ability and without removing any material from the body of the instrument.

The special bolts supplied with the bridge system permit the tailpiece and/or the intonation bridge to be raised or lowered with respect to the face of the instrument to suit the player's preference, for example, the distance of the strings from the fingerboard. It should be noted that as the bolts are screwed further in, lowering the tailpiece, the pressure on the tremolo lever required to produce the tremolo effect increases, which is preferred by some players.

The bolt for the tailpiece may have a circumferential groove of substantially semi-circular section to receive the pivot for the lever mechanism on the tailpiece about which the tailpiece is arranged to pivot to vary the tension in the strings. The tailpiece is advantageously provided with a roller-bearing effectively to eliminate any friction with the pivot.

The tremolo lever may be locked in the playing position, but may be removable to allow the instrument to be housed in its original carrying case.

The device, which was devised specifically for use with an electric guitar, lends itself to use on other stringed instruments.

Surprisingly, contrary to initial expectations, string life is in no way diminished by such over-tensioning, and can even be prolonged by careful design of the saddles on the tailpiece and on the intonation bridge. The bridge system may be designed so that saddle position in relation to each string can be individually adjusted so that musically all the strings are in tune both normally and in harmony when the tremolo effect is applied. Where the strings are over-tensioned to produce the tremolo effect they consistently remain in tune longer than if they had been de-tensioned to produce a similar effect.

The invention will now be described by way of example with reference to the accompanying diagrammatic drawings, in which.

Figure 4A:
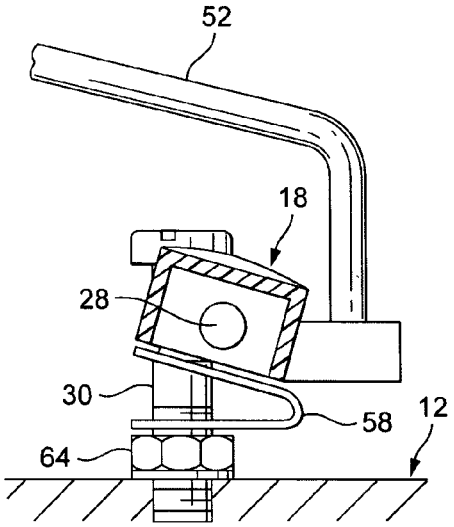
Figure 4B:
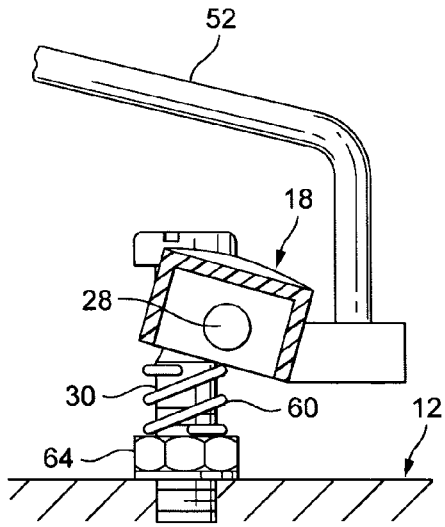
Figure 4C:
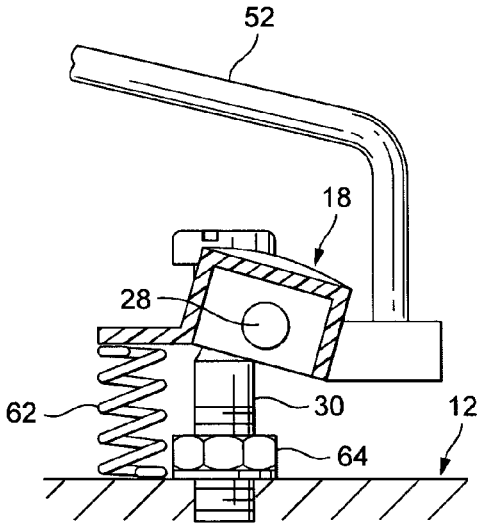
Figure 5A:
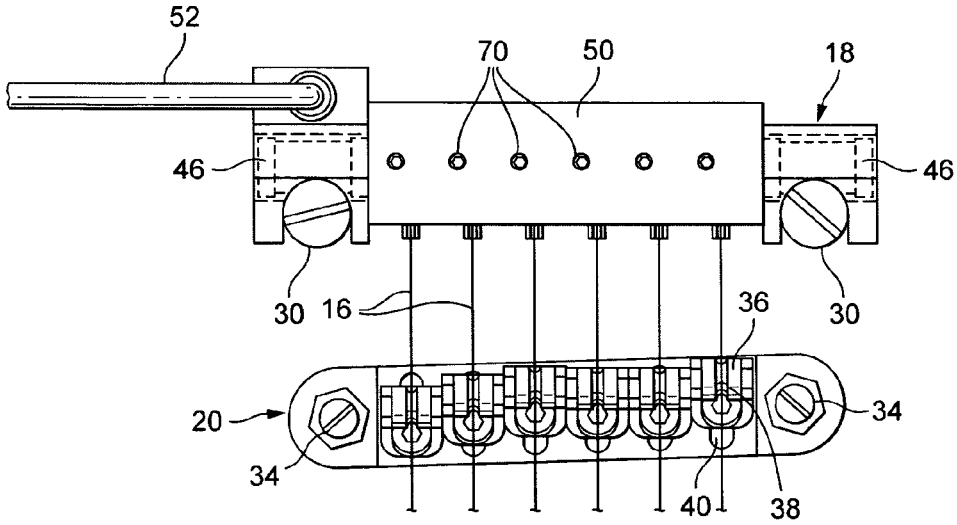
Figure 5B:
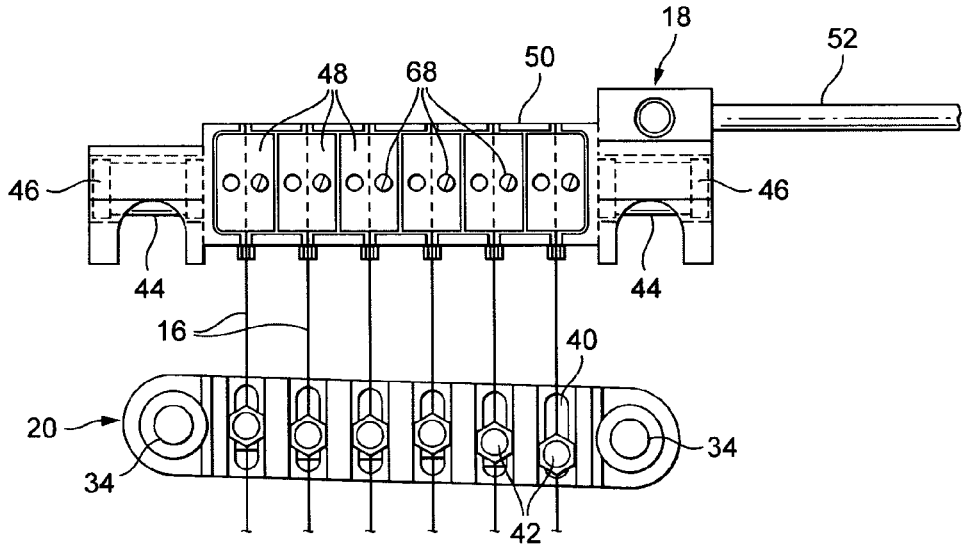
Figure 6:
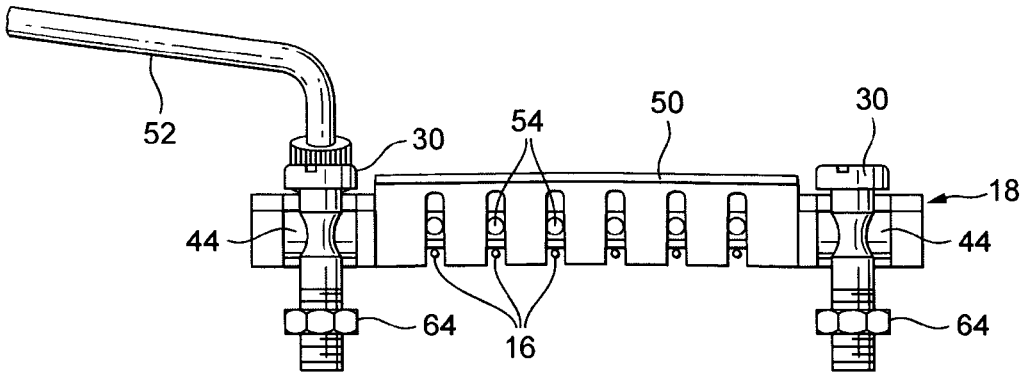
Figure 7:
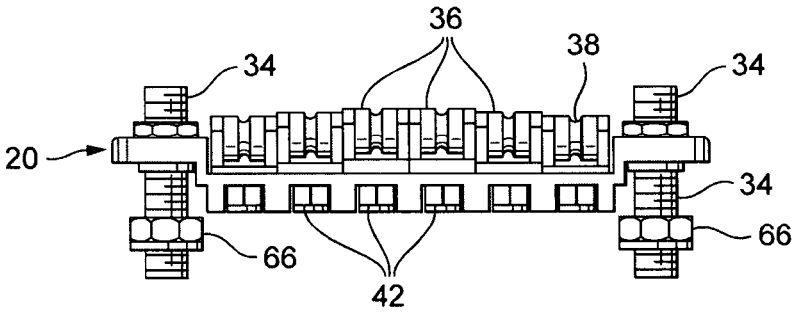

FIGS. 4A to C are a sectional side elevations of various spring arrangements to bring the tailpiece back to its 'normal' (tuned) position when the tailpiece is arranged to drop the tension of the strings to produce the tremolo effect;

FIGS. 5A and 5B are top and underside views respectively of the tailpiece and the intonation bridge;

FIG. 6 is a view of the tailpiece taken along the direction of the strings; 6A shows the pivot journal and the roller bearings at either end;

FIG. 7 is a similar view of the intonation bridge taken in the same direction as FIG. 6; and FIGS. 8 to 11 show the position of the saddle relative to the pivot on the tailpiece; the drawings on the left (A) show the saddle in its normal (home) position, and those on the right (B) show its position when fully activated (max).

Figure 1:
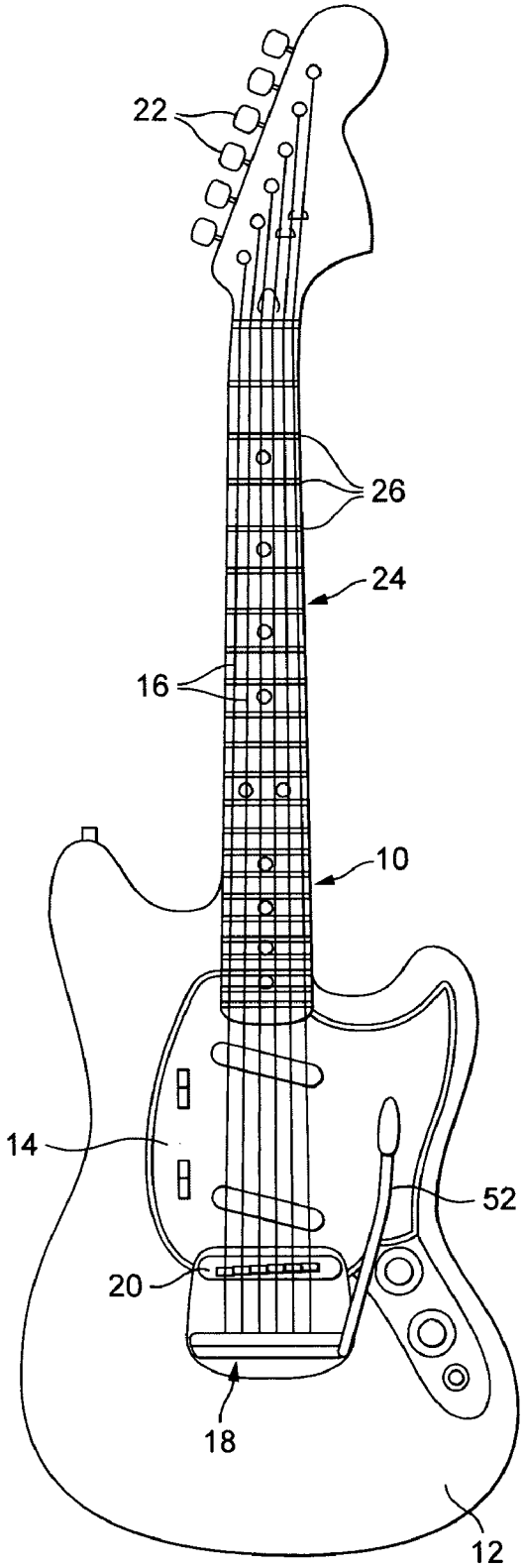
FIG. 1 is a top view of an electric guitar in order to show the overall arrangement of a guitar fitted with a tailpiece in accordance with the invention.

FIG. 1 shows an electric guitar 10 comprising a guitar body 12 with a sound table 14. The traditional six strings 16 are attached to a tailpiece 18 at one end, pass over an intonation bridge 20 and terminate around tuning keys 22 at the other. The tuning keys are at the outer end of a finger board 24 having a number frets 26 against which the various strings are pressed to select a desired note or chord.

Figure 2:
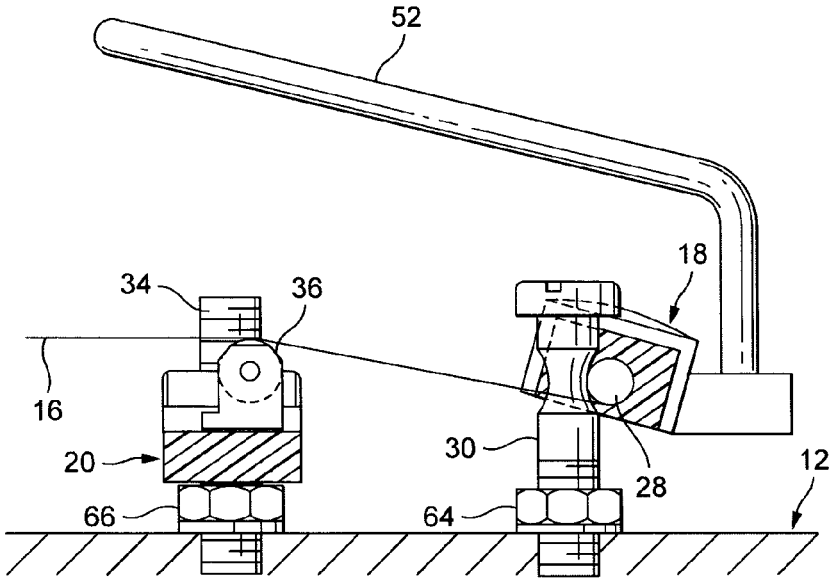
FIG. 2 is a sectional side elevation of the tailpiece in accordance with the invention; this view shows the abutment of the tailpiece pivot with supporting bolts on the guitar as well as a sectional elevation of an intonation bridge.

FIG. 2 is a sectional side elevation of a tailpiece 18 in accordance with the invention; this view shows the abutment of the tailpiece pivot 28 with the waisted supporting bolts 30 on the guitar. It also shows a sectional elevation of an intonation bridge 20 bolted at 34 to the guitar body 12. In this arrangement the tension in the strings 16 holds the tailpiece against the bolts 30 which also act as a fixed stop so that the tailpiece remains in the 'normal' (tuned) poison when the tremolo effect is not activated.

The strings 16 pass from the tailpiece 18 over rollers 36 on the intonation bridge 20. These rollers have a central slot 38 (shown in FIG. 5A). The rollers 36 each has a lengthwise screw adjustment 40 (FIG. 5B) allowing them to be adjusted and locked by nuts 42 in the direction of the strings 16 to adjust the length of the string to the frets 26 for intoning the instrument. The height above the body of the guitar of both the tailpiece 18 and the intonation bridge 20 can be adjusted by means of locking nuts 64,66 on the bolts 30, 34.

The pivot 28 is held against the waisted bolt 30 by the force from the tension in the strings 16. However, to reduce any resistance caused by friction between the pivot and the bolts 30, the pivot 28 is provided at either end with a cylindrical journal 44 (FIG. 6A) having small needle bearings 46 at each end. The bearings 46 fit the pivot tightly allowing the journal 44, and thus the pivot 28, to rotate freely against the bolts 30.

Figure 3A:
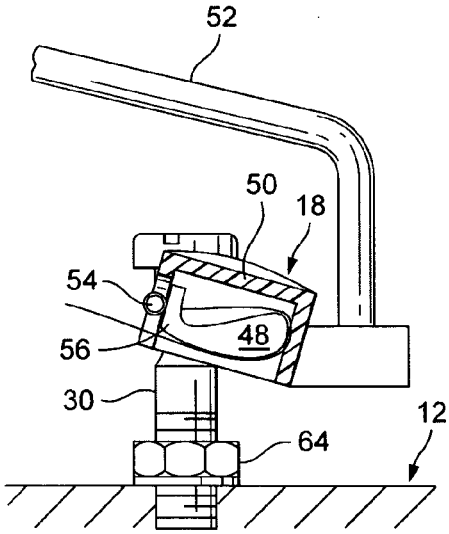
FIG. 3 is a sectional side elevation of a tailpiece in FIG. 2, but taken though a saddle which forms a part of the tailpiece; 3*a* shows the saddle arranged to over-tension the strings on activation of the tremolo lever; 3*b* shows the saddle as arranged to drop the tension on operation of the lever.

FIG. 3 is a sectional side elevation of the centre portion of the tailpiece 18 shown in FIG. 2. It shows the saddles 48 which are held in the tailpiece housing 50. In FIG. 3A the saddle 48 is shown in the position in which it will increase the tension in the string 16 when a tremolo lever 52 is pressed down (rotating it anti-clockwise). It will be noted that when the tremolo lever 52 is activated, rotating or tilting the tailpiece, each of the 6 saddles (in the case if a guitar) are rotated together.

Each string is held by a ball 54 at its end in a slot in an upstand 56 on the saddle 48. The string passes around the smooth rounded periphery of the saddle. It will be apparent that no significant additional force is placed on the ball 54 because of the friction of the string over the saddle. The life of the string is thus little impaired in spite of the additional tension when the tremolo effect is activated.

Figure 3B:
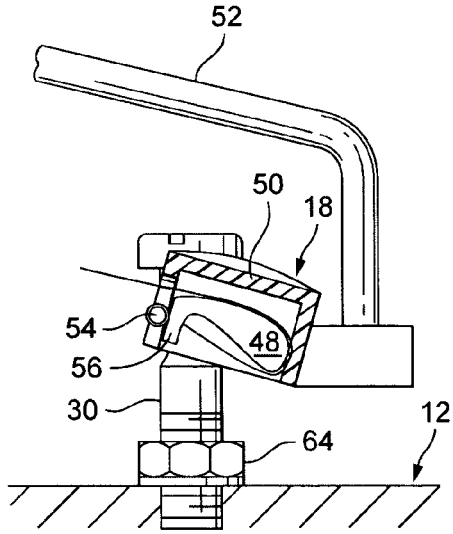

FIG. 3B is similar to FIG. 3A, but shows the saddle 54 reversed in its housing 50 to drop the tension on operation of the lever.

When more than one or two saddles 54 are 'reversed' as shown in FIG. 3*b* there may not be sufficient tension in the strings to bring the tailpiece housing back to its 'normal', tuned position. FIGS. 4A to C thus show diagrammatically various spring arrangements 58,60,62 to bring the tailpiece back to its 'normal' (tuned) position when the tailpiece is set up to drop the tension of the strings to produce the tremolo effect. It will be noted that none of the options shown requires any material to be removed from the body of the guitar 12.

FIGS. 5A and 5B are top and bottom views of the tailpiece 18 and the intonation bridge 20 arranged as they would be on a guitar. The six strings 16 pass in the slots 38 of their respective rollers 36 on the intonation bridge 20. As shown the rollers 36 have been adjusted to take account of the different lengths and string characteristics. In FIG. 5B the saddles 48 are shown with their adjustment screws 68 to the right. These screws 68 are used to adjust the offset of the saddles 48 from the axis of the pivot 28 as will be explained with reference to FIGS. 8 to 11. As the saddles 48 are reversible, holes 70 are provided in the upper side of the tailpiece housing 50 to give access to the adjustment screws 68 when the saddles 48 are mounted in the other sense.

Figure 6A:
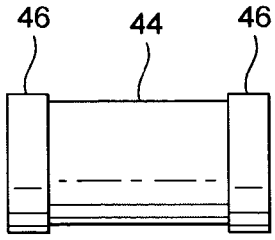

FIG. 6 is a view of the tailpiece 18 viewed along the direction of the strings 16; FIG. 6*a* shows the pivot journal 44 and the needle bearings 46 at either end;

FIG. 7 is a corresponding view of the intonation bridge 20 taken in the same direction as FIG. 6. In use, the strings (not shown) lie in the slots 38 of the rollers 36.

FIGS. 8 to 11 show the position of the saddle 48 relative to the pivot 28 on the tailpiece 18. The drawings on the left (A) show the saddle 48 in its normal or tuned position (X-axis in the home position) where the tremolo function has not been activated. The drawings on the right (B) show the position of the saddle 48 rotated through 14° (X-axis in the max position) when the tremolo lever 52 has been fully activated. Obviously, the player will choose by how much he wishes to activate the tremolo lever 52 from the home position to the max position to achieve the effect he desires.

Figure 8A:
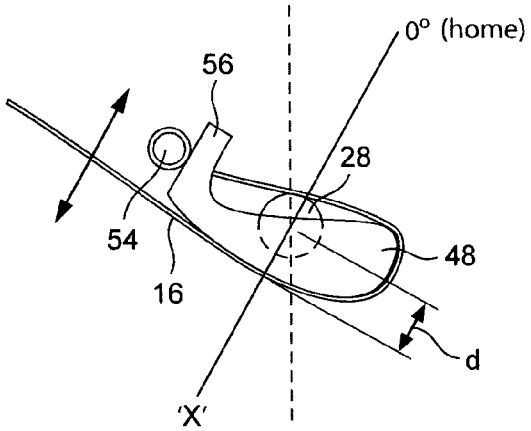
Figure 8B:
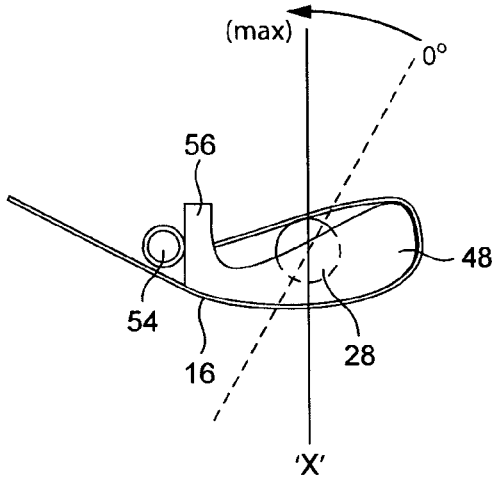

FIG. 8A shows the saddle 48 and the string 16 in its normal, at rest position in which the guitar is tuned, where the X-axis is on the line marked 'home'. In this position with the upstand 56 pointing outwardly from the body of the guitar 12, the saddle 48 is arranged so that when the tremolo lever is operated (turning the X-axis to max in FIG. 8B), the string 16 will be over-tensioned to produce the maximum tremolo effect. The amount of over-tensioning will depend on adjustment of the adjustment screws 68 which vary the offset d–the perpendicular distance between the string 16 and the centre line of the pivot 28. When the tremolo lever is activated as shown in FIG. 8B, typically turning the tailpiece 18 through about 14°, the string will be stretched by about 1½ to 3 mm. The offset d is adjusted by the player by means of the adjustment screws 68 for each string on which the tremolo effect is to be applied in order that those strings remain in harmony when the tremolo lever is activated.

Figure 9A:
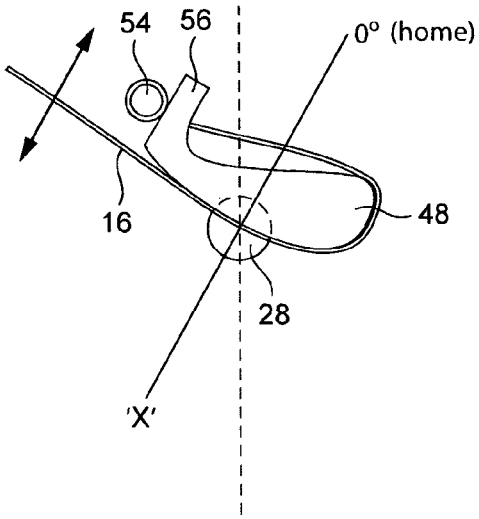
Figure 9B:
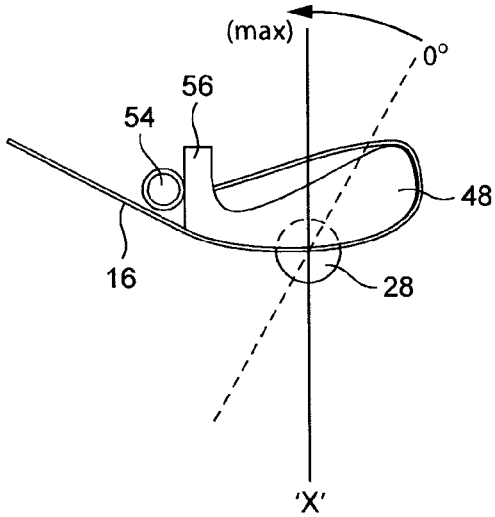

In FIG. 9 the offset d has been reduced to 0 mm and the string remains on the axis of the pivot 28 (FIG. 9A), so that in this case the tremolo effect has been de-activated for this string and when the tremolo lever is activated (FIG. 9B) there is no extension or relaxation of the string 16.

Figure 10A:
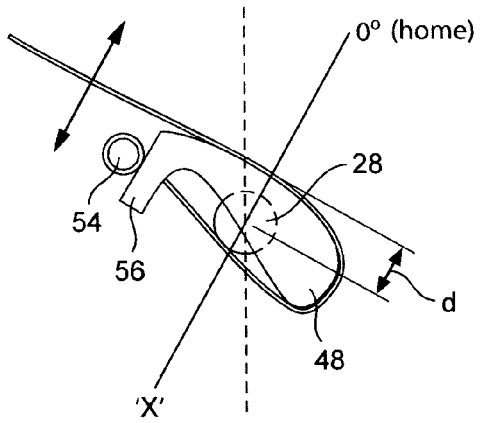
Figure 10B:
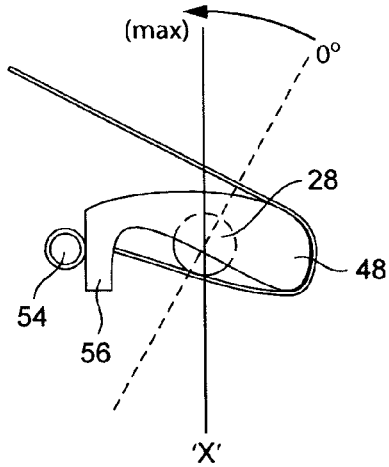

Referring to FIG. 10A, the saddle 48 and the string 16 in its normal, at rest position in which the guitar is tuned, marked home. In this position with the upstand 56 pointing inwardly from the body of the guitar 12, the saddle 48 is arranged so that when the tremolo lever is operated (FIG. 10B), the tension in the string 16 will be reduced or relaxed to produce the tremolo effect. The amount that the tension is dropped will depend on adjustment of the adjustment screws 68 which vary the offset d–the perpendicular distance between the string 16 and the centre line of the pivot 28. In this case when the tremolo lever is activated (FIG. 10B), typically turning the tailpiece 18 through about 14°, the string will be released by about 1½ to 3 mm. The offset d is adjusted by means of the adjustment screws 68 for each string on which the tremolo effect is to be applied in order that those strings remain in harmony when the tremolo lever is activated.

Figure 11A:
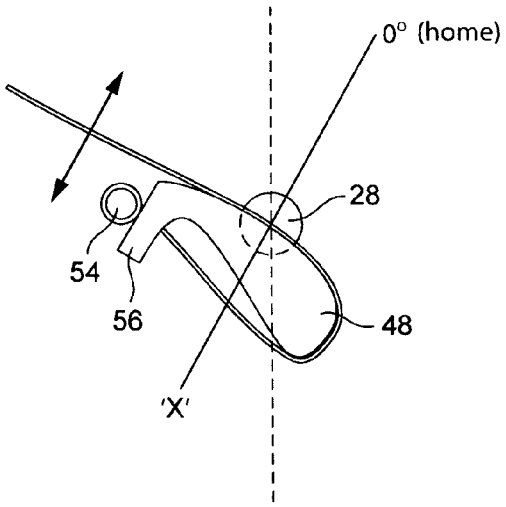
Figure 11B:
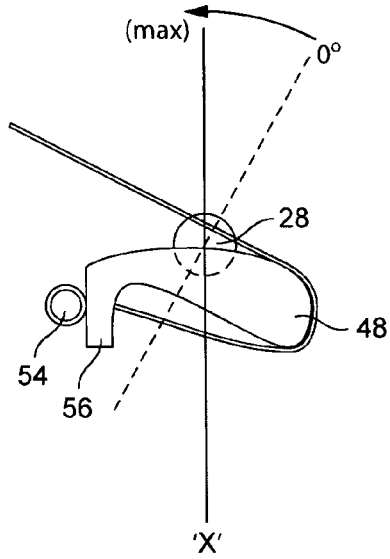

FIG. 11A shows a saddle 48 where the offset d has been reduced to 0 mm to de-activate the tremolo effect on that string so that when the lever is activated (FIG. 11B) the tension in the string can remain at its tuned setting.

There is no reason why some of the saddles can be arranged as shown in FIG. 8A, others as shown in FIG. 9A, and others as shown in FIGS. 10A and 11A to produce the effect desired by the player. It should be noted that if the majority of the strings are to be dropped in tension on operation of the tremolo lever 52, a spring or springs as shown in FIGS. 4A, 4B and 4C will be required to hold the tailpiece against its fixed stop. If the majority of the strings are tensioned on operation of the tremolo lever, no springs are required, and it has been found additionally that the instrument remains in tune for longer.

The use of the saddles 48 and their smooth form produces a much improved means for attaching the strings to the tailpiece and almost eliminates the most common cause of failure of the strings in the region of the tailpiece.

The invention claimed is:

1. A bridge system for producing a tremolo effect on a stringed instrument comprising:

a tailpiece for anchoring a plurality of strings of the instrument and arranged to be fitted with a tremolo lever, characterised in that the tailpiece is pivotable about an axis substantially perpendicular to an axis of at least one of the plurality of strings in order to change a tension in the strings so as to provide the desired tremolo effect, wherein the tailpiece is provided with a plurality of saddles corresponding to the plurality of strings, each saddle being provided with a slot for anchoring its string, and wherein each saddle includes an asymmetric curved form about a saddle pivot axis wherein each string contacts and is looped over an exterior surface of the asymmetric curved form of its respective saddle over an angle of 270° to 360°, and each saddle is individually and independently adjustable with respect to the pivot axis so that in use the saddles are adjusted for the strings to remain in harmony when the tailpiece is pivoted.

2. A bridge system as claimed in claim 1 in which each of the saddle elements may either be mounted in the tailpiece in a 'normal' position whereby the tension in its string is arranged to be increased when the tailpiece is pivoted, or mounted in an inversed position whereby the tension in the string is arranged to be decreased when the tailpiece is pivoted.

3. A bridge system as claimed in claim 1 having a separate intonation bridge having separate rollers for each string, each roller being adjustable longitudinally.

4. A bridge system as claimed in claim 3 in which the tailpiece and/or intonation bridge are provided with holes at either end permitting it to be bolted to an instrument, using existing screw-threaded holes on the instrument.

5. A bridge system as claimed in claim 4 in which special bolts are provided permitting the tailpiece and/or the intonation bridge to be raised or lowered with respect to the face of the instrument to suit the player's requirements.

6. A bridge system as claimed in claim 4 in which the bolts for the tailpiece each have a circumferential groove of substantially semi-circular section to receive a cylindrical pivot of a lever mechanism on the tailpiece about which the tailpiece is arranged to pivot.

7. A bridge system as claimed in claim 1 in which the tremolo lever is removable to allow the instrument to be housed in its original carrying case.

8. An instrument fitted with a device as claimed in claim 1.

9. A bridge system for producing a tremolo effect on a stringed instrument comprising:

a tailpiece mounted to an instrument body, for anchoring a plurality of strings of the instrument, the tailpiece being arranged to be fitted with a tremolo lever, the tailpiece including a plurality of saddles each saddle accommodating a respective one of the plurality of strings, each string being fastened at one end to a ball which cooperates with the respective saddle, wherein the tailpiece is pivotable about an axis generally perpendicular to an axis of at least one of the plurality of strings in order to change a tension in the strings so as to provide the desired tremolo effect, and wherein each saddle includes an asymmetric curved form about a saddle pivot axis around which the respective string is wound over an exterior surface of the asymmetric curved form of its respective saddle over an angle of 270° to 360°, and each saddle is individually and independently adjustable with respect to the pivot axis so that in use the saddles are adjusted for the strings to remain in harmony when the tailpiece is pivoted.

10. A bridge system as claimed in claim 9 wherein each saddle further comprises an upstand and the ball cooperates with the upstand.

11. A bridge system as claimed in claim 9 in which the tailpiece is arranged to be held against a fixed stop by at least one of a) tension in the strings and b) one or more springs located between the tailpiece and the instrument body.

12. A bridge system as claimed in claim 9 further including a separate intonation bridge having separate rollers for each string, each roller being adjustable longitudinally.

13. A stringed musical instrument comprising:

an instrument body;

a tailpiece mounted to the instrument body for anchoring a plurality of strings of the instrument wherein the tailpiece is provided with a plurality of saddles corresponding to the plurality of strings, each saddle including a pivot axis;

a tremolo lever mounted to the tailpiece;

wherein the tailpiece is pivotable via the tremolo lever about an axis generally perpendicular to an axis of at least one of the plurality of strings in order to change a tension in the strings so as to provide a desired tremolo effect, and wherein each saddle includes an asymmetric curved form about a saddle pivot axis around which the respective string is wound over an exterior surface of the asymmetric curved form of its respective saddle over an angle of 270° to 360°, and each saddle is individually and independently adjustable with respect to the pivot axis so that in use the saddles are adjusted for the strings to remain in harmony when the tailpiece is pivoted.

14. A stringed instrument as claimed in claim 13 further including a separate intonation bridge having separate rollers for each string, each roller being adjustable longitudinally.

15. A stringed instrument as claimed in claim 13 wherein each saddle further includes a slot through which its respective string extends.

* * * * *

UNITED STATES PATENT AND TRADEMARK OFFICE

CERTIFICATE OF CORRECTION

PATENT NO. : 8,389,836 B2
APPLICATION NO. : 12/525379
DATED : March 5, 2013
INVENTOR(S) : René Uberbacher It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 258 days.

Signed and Sealed this
First Day of September, 2015

Michelle K. Lee

Michelle K. Lee
*Director of the United States Patent and Trademark Office*